United States Patent [19]

Tighe et al.

[11] Patent Number: 4,704,310

[45] Date of Patent: Nov. 3, 1987

[54] HEAT TRANSFERABLE LAMINATE

[75] Inventors: Laurence E. Tighe, Milford; Sushil Bhatia, Framingham, both of Mass.

[73] Assignee: Dennison Manufacturing Company, Framingham, Mass.

[21] Appl. No.: 900,119

[22] Filed: Aug. 25, 1986

[51] Int. Cl.[4] ..... B41M 5/26

[52] U.S. Cl. ..... 427/261; 427/541; 427/146; 427/148; 427/372.2; 427/385.5; 428/352; 428/349; 428/913; 428/914

[58] Field of Search ..... 428/42, 200, 202, 204, 428/207, 211, 349, 345, 352, 913, 914; 427/54.1, 146, 148, 261, 372.2, 385.5

[56] References Cited

U.S. PATENT DOCUMENTS

| | | | |
|---|---|---|---|
| 3,922,435 | 11/1975 | Asnes | 428/413 |
| 4,117,182 | 9/1978 | Andrews | 427/148 |
| 4,367,251 | 1/1983 | Crivello | 428/352 |

*Primary Examiner*—Marion C. McCamish
*Assistant Examiner*—C. Buczek
*Attorney, Agent, or Firm*—Barry D. Josephs

[57] ABSTRACT

An improved release coating for heat transferable laminate and improved method for curing the release coating for heat transferable laminates wherein an ink design layer is transferred from a carrier web onto an article such as a plastic or glass container upon application of heat and pressure. The improved release coating does not contain wax components but exhibits release properties similar to wax based formulations. The improved release contains U-V curable components which are cured by exposure to ultraviolet light after the laminate containing the ink design, is transferred to a receiving article. The heat transferable laminate preferably includes a barrier layer intermediate the release layer and ink design layer. The barrier layer also contains U-V curable components. The barrier layer is cured by exposure to ultraviolet radiation during formation of the laminate structure and prior to transfer of the laminate to a receiving article. The improved release formulation upon curing by ultraviolet radiation produces a hard, glossy, optically clear protective layer exhibiting enhanced resistance to abrasion, scuffing and solvent attack.

13 Claims, 1 Drawing Figure

HEAT TRANSFERABLE LAMINATE

BACKGROUND OF THE INVENTION

1. Field of the Invention.

The present invention relates to a heat transferable label and improved release composition therefor.

2. Description of the Prior Art.

Prior art heat transferable labels for imprinting designs onto an article typically involve decorative laminates consisting of a paper base sheet or web coated with a wax or polymeric release layer over which a design is imprinted in ink. The ink design is typically overcoated with a heat activatable adhesive layer.

Heat tranferable laminates having a wax based release layer, have the property that they soften readily at the desired heat transfer temperature, allowing the ink design layer and adhesive layer to transfer to the receiving article. The wax based release, during heat transfer, splits (i.e., bifurcates) from the carrier and a uniform portion of the release transfers along with the ink design layer to provide a protective coating over the ink layer upon transfer to the receiving article being decorated. Wax based release, however, after transfer to the receiving article, can be abraded when exposed to high degree of scuffing. They are also subject to attack by solvents to which the laminate may be exposed after transfer to the receiving article.

U.S. Pat. No. 3,616,015 is illustrative of the prior art. In U.S. Pat. No. 3,616,015 a lebal carrying web such as a paper sheet includes a heat transferable label composed of a wax release layer affixed to a surface of the paper sheet and an ink design layer superimposed onto the wax release layer. In the heat transfer labeling process for imprinting designs onto articles, the label carrying web is subjected to heat and the laminate is pressed onto an article with the ink design layer making direct contact with the article. As the web or paper sheet is subjected to heat, the wax layer begins to melt so that the paper sheet can be released from the wax layer. After transfer of the design to the article, the paper sheet is immediately removed, leaving the design firmly affixed to the surface with the wax layer exposed to the environment. The reference teaches that the wax release layer must not only permit release of the transferable label from the web upon application of heat to the web, but also must form a clear protective layer over the transferred ink design.

This commonly assigned patent discloses a wax release coating containing a modified montan wax which has been oxidized, esterfied, and partially saponified. In order to attain improved clarity of the transferred ink design the transferred wax coating over the ink design is subjected to additional heat processing after the label has been transferred onto an article. The additional processing involves postflaming, wherein the transferred wax coating is subjected to jets of high temperature gas either as direct gas flame or as hot air jets at temperatures of about 300° F. to 400° F. for a period of time sufficient to remelt the wax coating without substantially heating the bottle. Upon cooling of the remelted wax coating through use of ambient or forced cooled air, the cooled wax layer solidifies to form a clear, smooth protective coating over the transferred ink design. Although the heat transferable label and process disclosed in U.S. Pat. No. 3,616,015 represents an improvement over prior heat transferable labels, they are best suited to decoration of plastic articles which are not transparent. Although the heat transferable label disclosed in this reference may be utilized for decorating a wide variety of different plastics, there can be a degree of hazing or halo noticeable over the transferred label when the transfer is made onto clear plastic materials, despite use of postflaming.

U.S. Pat. No. 3,922,435 discloses a dry nonwax release heat transfer laminate to be transferred to plastic bottles. The laminate is composed of a backing sheet coated with a dry release layer which, in turn, is overcoated with an ink design layer and adhesive layer. The release layer is preferably composed of a cross-linked thermoset polymeric resin and does not contain wax components. Preferably the thermoset resin in the release layer is a cross-linked resin selected from acrylic resins, polyamide resins, polyester resins, vinyl resins, epoxy resins, epoxy-acrylate resins, allyl resins, aldehyde resins, such as phenol-formaldehyde resins and the aminoaldehyde resins, e.g., urea formaldehyde or melamine aldehyde. The release layer disclosed in this reference may also be the theremoplastic polypropylene which has the requisite softening point and adhesive characteristics. As the exposed surface of the laminate contacts a bottle or article to be decorated and heat typically between about 300° F. to 450° F. is applied to the backing, the dry release layer has the property that allows a clean peel of the ink design layer from it so that the ink design layer transfers to the article. The dry release as in U.S. Pat. No. 3,922,435 does not contain a wax component as in U.S. Pat. No. 3,616,015 and therefore functions differently than a wax based release. A wax based release as in U.S. Pat. No. 3,616,015 softens and splits on transfer. Thus, a portion of the wax release is left behind on the backing and the remainder transfers to the receiving article along with the ink design to form a protective coating thereon. The dry release as disclosed in U.S. Pat. No. 3,922,435 in contrast does not melt, i.e., remains "dry" and separates cleanly from the ink design layer on application of heat. The dry release does not transfer to the article being decorated, rather all of the dry release is left behind on the paper backing. The thermoset resins disclosed in this reference are applied to the backing sheet from a solution containing curing catalyst. After the solution containing the thermoset resin is coated onto the backing it is cured at curing temperatures typically between 250° F. to 350° F. to achieve cross linking of the polymer. The remaining layers including the ink design layer are subsequently coated over the dry release to form the laminate.

U.S. Pat. No. 2,990,311 discloses a heat transferable decal having a release transfer layer composed of a mixture of a crystalline wax and a synthetic thermoplastic film-forming resin, principally an organic linear thermoplastic film-forming resin which is substantially water insoluble. The degree of compatibility of the resin and wax is controlled through selection and ratio of the components to give heat transfers of either the hot peel or cold peel type. In the hot peel transfer, the decal will adhere and release from the backing only immediately after application while the decal is still hot. In the cold peel transfer the transferred decal will adhere to the receiving surface when hot but will only release and transfer by peeling away the backing after the transfer has cooled. In either type of transfer, this reference teaches that resins and waxes (the latter being used for the release layer) should be mutually incompatible or insoluble at temperatures below the melting temperature of the wax such that the molten wax, upon cooling, will acutally crystallize separately and distinctly from the resin. The resins are linear thermoplastic film-forming resins defined as essentially solvent-soluble, softened by heat and to involve only a minor amount or no cross-linkage.

U.S. Pat. No. 2,862,832 discloses a heat transferable decal having a release layer composed of an oxidized wax. The disclosure is directed principally to defining the type of wax found to provide suitable release of the decal from the carrier web upon application of heat. The wax disclosed in this reference is an oxidized wax obtained as the reaction product of the oxidiation of hard, high melting, aliphatic, hydrocarbon waxes. The oxidized waxes are defined as the oxidation products of both natural and synthetic hydrocarbon waxes such as petroleum waxes, low molecular weight polyethylene and waxes obtained from the Fischer-Tropsch synthesis. Suitable wax may include oxidized microcrystalline wax or the esterification product of an oxidized hydrocarbon wax. The oxidized waxes are disclosed as those having melting points between about 50° C. and 110° C., saponification values between about 25 and 100, acid values between about 5 and 40, and penetrometer hardness (ASTM D5-52) below about 51 as measured with 100 grams for 5 seconds at 25° C.

In U.S. Pat. No. 3,616,176 the laminate is composed of a base sheet, with a polyamide layer covering the base sheet and a decorative ink layer covering the polyamide layer. Sufficient heat is applied to the laminate to heat the polyamide layer at or above a softening point, and the laminate is then pressed onto the surface of an article with the decorative ink layer coming into direct contact. Upon withdrawl of the heat source, the polyamide layer cools to a temperature below the softening point and the base sheet is removed. The decorative layer becomes fused or heat sealed to the article. The polyamide layer in this disclosure functions as a release coating which allows transfer of the decorative layer onto an article and upon cooling serves as a protective coating layer over the transferred decorative layer. The use of a polyamide release coating has the principal disadvantage in that there is a significant tendency for the polyamide to form a noticeable halo about the transferred decorative layer. Also the polyamide layer, even when subjected to additional processing such as post-flaming, does not form sufficiently clear coating that would esthetically permit heat transfer labelling onto clear articles or bottles.

U.S. Pat. No. 4,557,964, 4,581,266, and 4,536,434 are additional prior art references which discloses a heat transferable laminate utilizing a wax based release layer. Specific classes of tackifying agents are added to the wax release to improve the clarity and function of the release coat after transfer of the laminate to an article whereupon the release functions as a protective layer over the ink design. The release compositions disclosed in these references are of the wax based type and therefore are not applicable to the formulations disclosed in the present patent application.

Accordingly, it is an object of the present invention to provide a nonwax based release for heat transfer laminates wherein the release exhibits improved characteristics of abrasion and scuff resistance, and resistance to attack by solvents to which the laminate may come into contact after transfer to the receiving article.

It is an important object of the present invention that the nonwax based release function as a wax release on application of heat to the laminate. Thus, it is important that the nonwax release split on application of heat thus causing a uniform portion of the release to transfer to the receiving article along with the ink design layer and completely cover the ink layer on transfer.

It is a further important object that the nonwax release be curable by ultraviolet light after transfer to the article.

SUMMARY OF THE INVENTION

In accomplishing the foregoing and related objects, the invention provides a heat transferable laminate having an improved nonwax release composition, and improved barrier layer composition intermediate the release layer and ink design. The laminate is heat transferable from a carrier web to a receiving article such as a plastic or glass bottle. The heat transfer laminate is typically affixed to a carrier web such as a paper or plastic sheet. The laminate is composed of a nonwax release layer coated on the carrier web, a barrier layer coated over the release layer, in turn coated with an ink design layer. A heat activatable adhesive is preferably included over the ink design. The article to be decorated is pressed onto the exposed surface of the laminate while heat and pressure is applied to the carrier web. The applied heat causes the release layer to melt and split. Simultaneously the exposed surface of the laminate, in contact with the receiving article becomes tacky. Thus, the laminate releases from the carrier web and adheres to the surface of the article being decorated. The release layer splits to form a uniform protective coating layer over the ink design transferred to the receiving article.

The laminate of the present invention does not incorporate wax components in the release layer and has advantages over prior art release compositions containing wax. Principal advantages of the release formulation of the present invention is that it provides a more abrasive resistant and solvent resistant protective coating over the ink design after transfer and subsequent curing than is heretofor possible using conventional release compositions which contain wax components. The release composition exhibits thermoplastic properties during transfer and splits from the carrier web to form a uniform protective coating over the transferred ink design to completely cover the ink design on the article. It thus splits much like the prior art wax release layers for heat transferrable laminate, but nevertheless does not contain a wax component. The release of the present invention is optically clear after transfer, and subsequent curing of the transferred release does not diminish its optical clarity.

The nonwax release composition of the present invention contains components which are curable by exposure to ultraviolet light. The nonwax release layer is exposed to ultraviolet light and thus cured only after the substrate containing the ink design layer is transferred to the receiving article. After transfer of the laminate to the article, the exposed nonwax release layer on the surface of the transferred laminate is subjected to ultraviolet radiation of proper intensity, wave length range and exposure time to cure the U-V curable components therein. The cured components in the release layer, after curing with ultraviolet radiation, forms a hard, glossy, protective coating of exceptional optical clarity over the ink design. The cured release layer exhibits enhanced resistance to abrasion and scuffing as well as enhanced resistance to solvent attack.

The nonwax release composition of the present invention is composed essentially of U-V (ultraviolet) curable components and appropriate photoinitiator (catalyst). Since the U-V curable components and photoinitiators are solids, then appropriate solvents must be included so that a liquid mixture is obtainable for coating onto the carrier web using conventional coating methods such as gravure or reverse roll coating. Applicants have determined that suitable U-V curable components for use in the present release composition may be selected from the class of acrylated urethanes, acrylated epoxies and acrylated styrenes of ultraviolet curable monomer or oligomer. A preferred class of U-V curable components for use in the release layer may be selected advantageously from the U-V curable urethane oligomer. A preferred urethane oligomer is an acrylated urethane oligomer. If the U-V curable acrylated urethane oligomer is employed, then a preferred photoinitiator for use in the release formulation has been determined to be benzophenone. Since the U-V curable acrylated urethane oligomer and benzophenone are solids a conventional solvent, or solvent blend, for example, methyl ethyl ketone can be included to produce a homogeneous liquid which may be readily coated onto the carrier web.

The heat transfer laminate of the present invention advantageously includes a nonwax barrier layer intermediate the nonwax release layer and the ink design layer. The barrier layer also contains U-V curable components and is coated on the nonwax release layer in a liquid state using conventional gravure or cast coating methods. After the barrier layer is coated onto the release layer during formation of the laminate on the carrier web, the barrier layer is exposed to ultraviolet light to cure the U-V curable components therein. The curing of the barrier layer must be accomplished at the appropriate wave length range, intensity, and exposure time to prevent curing of the components in the underlying release layer.

The barrier layer is composed essentially of U-V curable components and photoinitiator. Applicants have determined that suitable U-V curable components for use in the barrier layer may be selected from the chemical class of monomers and oligomers with acrylic, methacrylic, vinyl or allylic functional groups. Applicants have determined that preferred U-V curable components for the barrier layer may be selected from polyacrylate ester monomer (liquid) and polyol polyacrylate oligomer (liquid). Thus, one preferred formulation for the barrier layer is composed of the U-V curable component which is a polyacrylate ester monomer (liquid) and a photoinitiator which is an aromatic ketone photoinitiator. An alternate preferred formulation for the barrier layer is composed of two U-V curable components. The first U-V curable component is a polyacrylate ester monomer (liquid) and the second is a polyol polyacrylate (acrylated diol oligomer) and a photoinitiator which is an aromatic ketone photoinitiator.

DETAILED DESCRIPTION

Figure 1:
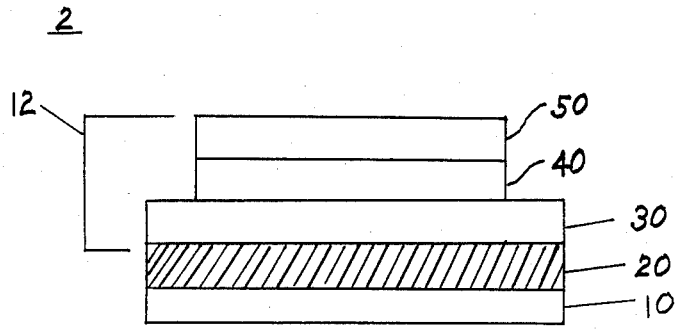
FIG. 1 is an illustration of a preferred embodiment of the composite heat transferable laminate.

The preferred embodiment of the heat transferable laminate 2 of the invention as illustrated in FIG. 1, is composed of a carrier web 10, typically paper, overcoated with a nonwax release layer 20, overcoated with an ink design layer 40 and a heat activatable adhesive layer 50. A barrier layer 30 is preferably included between nonwax layer 20 and the ink design layer 40 as illustrated in FIG. 1. Nonwax release layer 20, barrier layer 30, ink design layer 40 and adhesive layer 50 form a transferable substrate 12 which releases from a carrier web 10 upon application of heat to web 10 sufficient to cause the nonwax release layer 20 to soften and split from a carrier web 10. As heat is applied to carrier web 10 and a receiving article such as a plastic bottle is pressed onto the exposed adhesive surface of substrate 12, the transferable substrate 12 splits from carrier web 10 and transfers onto the surface of the article with the ink design layer 40 clearly visible on the article. As the release 20 splits it bifurcates leaving one portion on substrate 12 and another portion on carrier 10.

The heat transferable laminate of the invention exhibits properties which represent an advance over prior art heat transferable laminate which employ either a wax based release coating or a dry release layer which is typically composed of a nonwax thermosetting or thermoplastic such as polypropylene. The heat transferable laminate of the present invention also satisfies a number of stringent physical property requirements simultaneously. The heat transfer laminate of the present invention functions as a wax based release in that it splits upon application of heat to the carrier web and results in transfer of a uniform portion of release 20 along with heat transferable substrate 12 to the receiving article as in the case of a wax based release. The nonwax release layer 20 provides a protective coat over the ink design layer after transfer to the receiving article as in conventional wax release layers, for example, as described in U.S. Pat. No. 3,616,015. Release 20, however, after transfer to the receiving article, is subjected to ultraviolet light to effect curing and cross linking of components therein.

Unlike prior art wax based release, however, the nonwax release layer 20 is composed of components which are curable by exposure to ultraviolet light. Release layer 20 is not exposed to ultraviolet light until after it has been transferred to the receiving article along with substrate 12. Thereupon, the exposed release layer 20, while on the receiving article, is subjected to ultraviolet radiation whereupon the components contained therein crosslink and cure to form a clear, hard abrasion and scuff resistant protective coating over the ink design layer 40. Curing of release 20 with ultraviolet radiation after transfer of the release 20 and substrate 12 results in a protective coating over the transferred ink design 40. The resulting protective coating shows marked resistance to attack by solvents such as methyl ethyl ketone, toluene, ethyl acetate or isopropanol to which the heat transferable substrate 12 could be later subjected while on the receiving article. These improved characteristics of enhanced resistance to abrasion and solvent attack far exceeds that obtained when using prior art wax based release layers in heat transferable laminates such as, for example, described in U.S. Pat. No. 3,616,015 or U.S. Pat. No. 4,581,266. Release 20 of the present invention also represents a clear advance over the so called dry release heat tranferable labels of the type described in U.S. Pat. No. 3,922,435. The dry release as in U.S. Pat. No. 3,922,435 does not transfer from the carrier web and thus does not form a protective coating over the transferred ink design on the receiving article. Instead the dry release simply remains intact on the carrier web as the ink design and remaining layers transfer to the receiving article on application of heat and pressure.

The preferred embodiment of the heat transferable laminate includes a barrier layer 30 between nonwax release layer 20 and the ink design layer 40. The barrier layer is preferably composed of components which may be cured and cross-linked by exposure to ultraviolet light after layer 30 has been coated onto release layer 20, thus, barrier layer 30 is subjected to ultraviolet radiation before the ink design layer 40 is coated thereon. The barrier layer 30, after ultraviolet curing, produces a coating which has the principal function of preventing nonwax release layer 20 from contacting the underside of carrier web 10 as the heat transfer label is rolled up for storage prior to the heat transfer operation. Applicants have determined that the barrier layer 30, after curing by ultraviolet radiation has less tack than the uncured release layer 20 and thus prevents release layer 20 from sticking to carrier web 10 during the unrolling of the heat transferable laminate just prior to use. Thus, barrier layer 30 prevents any problem of "blocking", that is, inadvertent sticking in blocks or strips of portions of the heat transferable substrate to the underside surface of carrier web 10 upon unwinding the heat transfer laminate 2 just prior to use in decorating articles. Barrier layer 30, once cured, also serves as a shield that prevents the solvents of ink layer 40 from penetrating into the release layer 20 and solvating the uncured oligomer(s) in release 20.

All layers coated on carrier web 10 are coated in a liquid state. Coating of the carrier 10 is most readily effected by use of gravure methods, but each of the layers 20, 30, 40, and 50 could be coated by other methods such as conventional cast coating including reverse roller coating. Other methods may be used to deposit each layer such as letter press, flexographic or screen printing methods. After coating each layer, any solvent which is present in the layer, must be evaporated before the next layer is coated thereon. Evaporation of solvents contained in each of the layers is effected by subjecting each coating which contains solvent to forced convective drying by hot air to evaporate the solvent.

Ink design layer 40 and heat activatable adhesive layer 50 are of conventional formulation. The ink design layer 40, thus may be composed of any conventional ink of any color. The ink may typically include resinous binder bases compatible with the ink pigment employed. Ink binder is readily selected from a wide variety of conventional resinous bases such as polyamide, polyvinyl chloride, acrylics, and polyamide nitrocellulose. The adhesive layer 50 is of the heat activatable type and is of conventional formulation. For example, adhesive layer 50 is suitably composed of a thermoplastic polyamide adhesive. A preferred thermoplastic polyamide adhesive is the reaction produt of a diamine with a dimerized fatty acid such as that available under the trade name VERSAMID 900 Series from the HENKEL CORP., of Minneapolis, Minn. It has been found advantageous to combine the polyamide component with a nitrocellulose base to form the adhesive layer 50. Although it is desirable to have a separate adhesive layer 50 over ink design layer 40, it will be appreciated that adhesive layer 50 may be omitted, by including heat activatable adhesive components into the ink formulation. For example, it is known to impart heat activatable adhesive properties to conventional nitrocellulose based inks by including a polyamide. Specific formulations of heat activatable adhesive inks for use in heat transferable laminates obviating the need for a separate adhesive layer are illustrated for example in U.S. Pat. No. 4,466,994. Thus, the formulations shown in this reference may be used for ink design 40, thus eliminating adhesive layer 50.

The nonwax release layer 20 has the property that during heat transfer it splits from the carrier 10 to provide a complete protective coating over the entire surface area of barrier 30 and ink design 40. It is a requirement that as the release splits from the carrier that the transferred release completely covers all the surface area of barrier 30 and ink design 40. The formulation of release layer 20 meets this requirement. The nonwax release layer 20 also has the requisite property to prevent "pick-off" problems from occurring. "Pick-off" problems, that is removal of portions of the release layer 20 when coating the barrier layer 30 thereon, does not occur with the present formulation for release 20. Similarly the formulation for barrier layer 30 prevents "pick-off" problems from occurring when ink design layer 40 is coated thereon. Barrier layer 30, after it has been subjected to curing by ultraviolet light, has the requisite hardness that allows the ink design layer 40 to be coated thereon while preventing embossing of the ink design layer into the barrier layer. The barrier layer, after curing with ultraviolet light, also exhibits the requisite barrier properties to prevent ink from migrating into release 20. Release layer 20 of the present invention, permits transfer of the transfer substrate 12 containing ink design layer 40 to occur at conventional heat transfer temperature of about 300° to 450° F. As a platen is heated to a temperature between about 300° to 450° F. and pressed onto carrier web 10 while a receiving article, such as a plastic bottle is simultaneously pressed onto adhesive layer 50, the nonwax release layer 20 begins to melt allowing release layer 20 to split from carrier 10 whereupon transfer substrate 12, containing ink design layer 40, transfers to the receiving article. As release 20 splits it bifurcates leaving one portion on substrate 12 and another portion on carrier 10. Release layer 20 splits relatively uniformly and provides an even protective coating over barrier layer 30 and ink design 40 upon transfer to the article. Thereupon, the transferred portion of release layer 20 is subjected to ultraviolet light while the transfer substrate is on the article in order to cross-link and cure the U-V (ultraviolet light) curable components in the release formulation. Upon curing, release layer 20 exhibits the enhanced properties of resistance to abrasion and scuffing and resistant to solvent as aforementioned. Ordinarily, if a wax release were employed for release layer 20, the transferred laminate on the article would be subjected to post flaming as, for example, described in U.S. Pat. 3,616,015 in order to remelt the transferred release layer and form a smooth glossy film of improved clarity. The post flaming step, when employing the release formulation 20 of the present invention, can be eliminated because release layer 20 after curing with ultraviolet light, is already in a sufficiently smooth, glossy and clear state. Curing using ultraviolet light uses far less energy and is easier to control than postflaming. The elimination of the time consuming and delicate post flaming step in the present invention is a distinct advantage over the prior art wherein wax based release is employed. The optical clarity of transferred release layer 20 after curing is of overall high degree to virtually eliminate problems of hazing or halo which is often encountered when employing a wax based release layer. The heat transferable laminate of the present invention can be suitably applied to a variety of plastic and glass articles of varying shades as well as to articles and containers composed of optically clear plastic materials without sacrifice in the properties of the transferred release aforementioned.

The preferred formulation for nonwax release layer 20 includes a U-V (ultraviolet light) curable component, a photo-initiator (catalyst) and solvent. A preferred U-V curable component is available under the trademark UVITHANE oligomer. UVITHANE oligomer is available from Morton Thiokol, Inc., CHEMICAL DIVISION, Princeton, N.J. A preferred UVITHANE oligomer for use in release formulation 20 is available under the trade name UVITHANE 788 oligomer. UVITHANE 788 oligomer is a non-yellowing urethane based material which can be cured to an abrasion resistant, tough, flexible film. UVITHANE 788 oligomer cures on exposure to ultraviolet light in the presence of a photo-initiator catalyst. Typical properties of a UVITHANE 788 oligomer is that is has a low melting solid appearance, a color, APHA (oligomer diluted 20 parts to 100 parts $MeCl_2$) of 50 max.; mild odor; a density at 25° C. of 1.2 kilograms per liter; a viscosity at 120° F. of 2200 to 4200 poise, a viscosity at 160° F. of 300 to 750 poise and a viscosity at 180° F. of 100–200 poise; an unsaturation equivalent per 100 grams of between 0.145–0.175 and an isocyanate content of 0.2% by weight max. The preferred photo initiator for use with the UVITHANE 788 urethane oligomer is benzophenone. Benzophenone has a molecular weight of 182.21 and is available as a white to off-white fine solid from the Upjohn Company, Fine Chemical Division, North Haven, Conn. Benzophenone is typically available from the UpJohn Company in a purity of not less than 98% and has a melting of between about 45°–49° C. and volatiles of not more than 0.1%.

A preferred solvent for use in the formulation for release coating 20 can be selected from any solvent that allows the U-V curable component and photo initiator to dissolve therein and form a homogenous solution. A solvent which has been found satisfactory for this purpose is methyl ethyl ketone. Inhibitors such as phenothiazine, benzoquinone or hydroquinone may be added to the release formulation to extend the storage life of the formulation.

A preferred formulation for the barrier layer 30 is 4omposed of a U-V curable component and a photoinitiator. A preferred U-V curable component is a polyacrylate ester monomer available under the tradename SARTOMER monomer. A preferred SARTOMER monomer is SARTOMER 9020 monomer available from the ARCO CHEMICAL COMPANY of Newtown Square, Pa. The SARTOMER 9020 monomer is an aliphatic ester monomer which is a polyacrylate ester; more specifically a propoxylated glycerine triacrylate. Typical properties of SARTOMER 9020 monomer are clear liquid appearance, low toxicity, greater than 98% reactive esters, 50 APHA color, molecular weight of 428, specific gravity at 25° C. of 1.0704, viscosity at 25° C. of 70 to 90 CPS, inhibitor level of about 250 to 350 ppm methyl ethyl hydroquinone (MEHQ) and flash point of 230° F. A preferred photoinitiator which may be used in the preferred formulation for layer 30 along with the SARTOMER 9020 monomer is a aromatic ketone photoinitiator. A preferred aromatic ketone photoinitiator is available under the trademark IRGACURE 907 available from CIBA-GEIGY CORP., Hawthorne, NY. IRGACURE 907 photoinitiator chemically is 2-methyl-1-[4-(methylthio) phenyl]-2-morpholino-propanone-1 and is a white to slightly yellow crystalline powder with a molecular weight of 279.4, a melting range of 72°–76° C. and a density of 1.21 gram per cubic centimeters. The IRGACURE 907 photoinitiator has been determined to be a particularly suitable photoinitiator to initiate ultraviolet light curing of the monomer SARTOMER 9020 liquid. The SARTOMER 9020 polyacrylate ester monomer is a liquid which is miscible with photoinitiator IRGACURE 907 (Solid) to form a miscible homogeneous solution. Consequently, it is not necessary to add solvents to this mixture to deposit the barrier layer 30 employing gravure or conventional cast coating methods.

An alternative perferred formulation for barrier layer 30 may include several different species of U-V curable components preferably in liquid form, along with the photoinitiator. A preferred formulation, which employs two U-V curable components, is composed of a first U-V curable component which is the polyacrylate ester SARTOMER 9020 liquid monomer and the second U-V curable component is a polyol polyacrylate available under the trademark SARTOMER 2000 liquid from Arco Chemical Co., Newtown Sq., Pa. The SARTOMER 2000 oligomer is an unsaturated aliphatic ester which is a polyol polyacrylate, more specifically it is an acrylated diol oligomer. The preferred photoinitiator for use with the U-V curable components, SARTOMER 9020 monomer and SARTOMER 2000 oligomer is the IRGACURE 907 aromatic ketone photoinitiator available from CIBA GEIGY CORP., of Hawthorne, N.Y.

Preferred compositions for release layer 20 are shown in Tables I, II and III. These Tables reflect preferred compositions for the nonwax release coating 20 and the barrier layer 30. In Table III the U-V curable component I may be present in a range between about 35 to 45 wt. %, and U-V curable component II may be present in a range between about 35 to 45 wt. % and the photoinitiator may be present in a range between 10 to 30 wt %. In Table II the U-V curable component may be advantageously between about 70.0 to 90.0 wt.% and the photoinitiator between about 10.0 to 30 wt. %.

TABLE I

| Preferred Formulation for Release Layer 20: | Comp. Wt. % |
|---|---|
| U.V Curable Component: | |
| Acrylated Urethane Oligomer (e.g., UVITHANE 788 oligomer (solid)) | 49.0 |
| Photoinitiator (Catalyst): | |
| Benzophenone (solid) | 1.0 |
| Solvent: | |
| Methyl Ethyl Ketone (liq.) | 50.0 |
| TOTAL | 100.0 |

TABLE II

| Preferred Formulation for Barrier Layer 30: | Comp. Wt. % |
|---|---|
| U.V. Curable Component. | |
| Polyacrylate ester monomer (e.g., SARTOMER 9020 monomer (liq.)) | 80.0 |
| Photoinitiator (Catalyst): | |

TABLE II-continued

| Preferred Formulation for Barrier Layer 30: | Comp. Wt. % |
|---|---|
| Aromatic ketone photoinitiator (e.g., IRGACURE 907 photoinitiator (solid)) | 20.0 |
| TOTAL | 100.0 |

TABLE III

| Alternate Preferred Formulation for Barrier Layer 30 | Comp. Wt. % |
|---|---|
| U-V Curable Component I | |
| Polyacrylate ester monomer (e.g., SARTOMER 9020 monomer (liq.)) | 35.0 |
| U-V Curable Component II | |
| Polyol polyacrylate oligomer (e.g., SARTOMER 2000 oligomer (liq.)) | 35.0 |
| Photoinitiator (Photocatalyst) | |
| Aromatic ketone photoinitiator (e.g., IRGACURE 907 photoinitiator (Solid)) | 30.0 |
| TOTAL | 100.0 |

The formulations shown in the Tables are specific formulations employing the components described in the foregoing. As may be seen from the Tables, one specific preferred formulation for release layer 20 is given in Table 1 and a preferred formulation as well as an alternative preferred formulation for barrier layer 30 are given in Tables II and III. The components at the composition shown in the Tables are blended at ambient temperatures using conventional air mixing equipment. The components are stirred until a homogeneous solution is obtained. Typical mixing times are up to about ½ hour using air mixing equipment. The solutions are then ready for coating using conventional gravure printing or conventional cast coating methods such as reverse roller coating methods. Coating of the laminate may be formed by first applying a coating of release layer 20 of composition shown in Table 1 onto carrier web 10 and then subjecting the coating to convective drying to evaporate solvents contained therein. The barrier layer 30 employing the formulation shown in Tables II or III may then be gravure coated onto the release layer 20. Since barrier layer does not contain any solvents, barrier layer 30 need not be subjected to the convective drying step.

After barrier layer 30 is coated onto the release layer 20, the barrier layer 30 is subjected to ultraviolet radiation sufficient to cross-link and cure the U-V curable components therein. The ultraviolet curing of barrier layer 30 may be accomplished under ambient temperature conditions. The curing of the barrier layer 30 can be accomplished using a H-Mercury bulb manufactured by Fusion Systems of Rockville, Md. A preferred H-mercury bulb is a 10" length bulb of a power of about 300 watts per inch of bulb length. This bulb emits ultraviolat light in a range of wave length between 200 and 450 nanometers with a peak wavelength at about 255, 315, 405 and 435 nanometers. It has been determined optimal to keep this bulb at a distance of about 8" from the surface of barrier coating 30 and subject the barrier coating 30 to the ultraviolet radiation generated by the bulb for an exposure time of less than about 1 second. It has been found that if the barrier layer 30 is subjected to too long exposure to the ultraviolet light or conversely if the ultraviolet light is of too great an intensity, a portion of the release layer 20 would become cured during the curing of barrier layer 30. This result would be undesirable because if release layer 20 were cured during curing of the barrier layer, the release layer would lose its thermoplastic wax-like properties and, in turn, would not split unformly as heat is applied to carrier web 10. Thus, it is necessary to provide the combination of proper intensity of U-V radiation and exposure time to assure that barrier layer 30 is cured without also curing the underlying release layer 20. After barrier layer 30 has been subjected to ultraviolet radiation and cured, ink design layer 40 may be applied in a conventional manner using gravure printing techniques. Solvents contained in ink design layer 40 are evaporated by convective drying in a conventional manner and thereupon adhesive layer 50 may be gravure coated or cast coated onto ink design layer 40. Adhesive coating 50 is subjected to convective drying to evaporate solvents contained therein to form the preferred composite laminate, as shown in FIG. 1.

In application, a heated-platen contacts the carrier web 10 and heats the carrier web to a temperature of 300°–450° F. while an article, typically a plastic bottle, contacts adhesive layer 50. As the platen heats the carrier web 10 the nonwax release layer 20 softens and splits instantly while adhesive layer 50 (or optionally ink layer 40 if adhesive 50 is omitted) simultaneously becomes tacky. This results in instant transfer of the substrate 12 to the receiving article. After substrate 12 has been transferred to the receiving article the exposed nonwax release layer 20 on the article must be subjected to curing by exposure to ultraviolet light. The transfer substrate 12 on the article is therefore passed under an ultraviolet light source of sufficient intensity and at proper exposure time to permit the curing of the exposed release layer 20 to take place. An adequate ultraviolet light source for curing of the release layer 20 on the article may be adequately effected by use of D-bulb doped murcury bulb (10" length) of power of 300 watts per inch. This bulb emits ultraviolet light in a range of wavelength between 200 and 450 nanometers with a peak wavelength at about 355, 365, 375 and 385 nanometers. A bulb of this type is available from the Fusion System Co. of Rockville, Md. The exposed release layer 20 on the article may be first subjected to the doped mercury D-bulb for a resident time of less than about 1 second with the bulb at a distance of about 4" away from the release 20 surface. A second stage of ultraviolet curing has been found to be desirable by then subjecting the partially cured release layer 20 to a second stage of ultraviolet light using the 10", H-mercury bulb of 300 wattage per inch and exposing the partially cured release surface to radiation therefrom for an exposure time of less than 1 second with the H-bulb at a distance of about 2" from the release surface. A two-stage curing, as described has been determined to provide optimal curing of the release layer 20 having the preferred formulation shown in Table I. The resulting cured release layer 20 forms a hard protective, glossy coating over the ink design 40 transferred to the receiving article. The cured release coating 20 also exhibits remarkable optical clarity and exhibits greater resistance to abrasion, scuffing and solvents, then would be obtainable if the release layer were a wax-based release.

It will be appreciated that variations of the specific formulations for the release layer and barrier layer may be prepared in a manner set forth in the specification without departing from the spirit and scope of the invention. Therefore, the invention is not intended to be limited to the preferred embodiments thereof or to any particular layer structure for the transferable laminate. The invention also is not intended to be limited to the description in the specification, but rather is defined by the claims and equivalents thereof.

We claim:

1. A method of transferring an ink design layer, which comprises the steps of:

(a) depositing a release layer onto a carrier web, said release layer comprising a photoinitiator catalyst and components curable by exposure to ultraviolet light, (b) depositing a barrier layer over the release layer, said barrier layer comprising a photoinitiator catalyst and components curable by exposure to ultraviolet light, (c) exposing the barrier layer to ultraviolet light to effect crosslinking of said curable components in the barrier layer essentially without also causing curing of said curable components in the release layer, (d) depositing an ink design layer over the barrier layer, (e) depositing a heat activatable adhesive layer over the ink design, (f) transferring the ink design layer from the carrier web to an article by applying the article in pressure contact to the adhesive layer while simultaneously applying sufficient external heat to the carrier web to melt the release layer so that the carrier web becomes separable from the ink design layer and transfers to the article along with the adhesive layer barrier layer and a substantial portion of the release layer, said transferred release forming a uniform coating over said transferred ink design on the article, (g) subjecting the transferred release portion on the article to ultraviolet light to effect crosslinking of the curable components in said transferred release to form an optically clear abrasive resistant protective coating over the transferred ink design on the article.

2. A method as in claim 1 wherein the curable components in the release layer comprises acrylated urethane oligomer.

3. A method as in claim 1 wherein the curable components in the barrier layer comprises polyacrylate ester monomet.

4. A heat transferable laminate of the type comprising a substrate affixed to a support member for transfer from the support member to an article upon application of heat to the support member while said article contacts the substrate, wherein the substrate comprises a release layer in contact with the support member and an ink design layer over the release layer, wherein the improved release layer comprises:

components comprising urethane oligomer, said components curable by exposure to ultraviolet light whereupon said components become cross linked, and the release further comprising a photoinitiator catalyst to initiate the cross linking of said components on exposure to ultraviolet light, the release not containing wax components, said release not subjected to curing until after transfer of said substrate to the article is effected, the release being thermoplastic during transfer and the release having the property enabling transfer of a sufficient portion of the release during transfer of the substrate to provide a coating of the release covering the transferred ink design on the article, the release subsequently cured by exposure to ultraviolet light resulting in an optically clear abrasion resistant protective coating over the transferred ink design on the article.

5. A heat transferable laminate as in claim 1 wherein the urethane oligomer in the release comprises acrylated urethane oligomer.

6. A heat transfer laminate as in claim 4 wherein the improvement further comprises said heat transfer laminate having a barrier layer intermediate the release layer and the ink design layer, said barrier layer comprises a photoinitiator catalyst and components curable by exposure to ultraviolet light, said curing of components in the barrier layer effected after the barrier layer is coated over the release.

7. A heat transferable laminate as in claim 4 wherein said components in the barrier layer curable by ultraviolet light comprises polyacrylate ester monomer.

8. A heat transfer laminate as in claim 7 wherein the components in the barrier layer curable by ultraviolet light further comprises a polyol polyacrylate oligomer.

9. A heat transferable laminate as in claim 6 wherein the photoinitiator catalyst in the barrier layer comprises an aromatic ketone photoinitiator.

10. A heat transferable laminate as in claim 4 wherein the photoinitiator catalyst in the release layer comprises benzophenone.

11. A heat transferable laminate of the type comprising a substrate affixed to a support member for transfer from the support member to an article upon application of heat to the support member while said article contacts the substrate, wherein the substrate comprises a release layer in contact with the support member and an ink design layer over the release layer, wherein the improved release layer comprises:

components curable by exposure to ultraviolet light whereupon said components become cross linked, and the release further comprising a photoinitiator catalyst to initiate the cross linking of said components on exposure to ultraviolet light, the release not containing wax components, said release not subjected to curing until after transfer of said substrate to the article is effected, the release being thermoplastic during transfer and the release having the property enabling transfer of a sufficient portion of the release during transfer of the substrate to provide a coating of the release covering the transferred ink design on the article, the release subsequently cured by exposure to ultraviolet light resulting in an optically clear abrasion resistant protective coating over the transferred ink design on the article, wherein the improvement further comprises a barrier layer intermediate the release layer and the ink design layer, said barrier layer comprising a photoinitiator catalyst and components curable by exposure to ultraviolet light, said curing of components in the barrier layer effected after the barrier layer is coated over the release.

12. A heat transferable laminate as in claim 11 wherein the components in the barrier layer curable by ultraviolet light comprises polyacrylate ester monomer.

13. A heat transfer laminate as in claim 12 wherein the components in the barrier layer curable by ultraviolet light further comprises a polyol polyacrylate oligomer.

* * * * *